United States Patent [19]

Bortz

[11] Patent Number: 4,818,369

[45] Date of Patent: Apr. 4, 1989

[54] LIQUID EFFLUENT RECYCLE TO REACTOR IN DEWAXING PROCESSES

[75] Inventor: Robert W. Bortz, Woodbury Heights, N.J.

[73] Assignee: Mobil Oil Corporation, New York, N.Y.

[21] Appl. No.: 140,873

[22] Filed: Jan. 6, 1988

Related U.S. Application Data

[63] Continuation of Ser. No. 5,358, Jan. 12, 1987, abandoned, which is a continuation of Ser. No. 767,572, Aug. 20, 1985, abandoned.

[51] Int. Cl.[4] ..... C10G 45/58

[52] U.S. Cl. ..... 208/100; 208/111; 208/120

[58] Field of Search ..... 208/100, 111, 120

[56] References Cited

U.S. PATENT DOCUMENTS

| | | | |
|---|---|---|---|
| 3,308,055 | 3/1967 | Kozlowski | 208/111 |
| 3,579,436 | 5/1971 | Mounce | 208/59 |
| 4,315,814 | 2/1982 | Shihabi | 208/111 |

*Primary Examiner*—Olik Chaudhuri

*Attorney, Agent, or Firm*—Alexander J. McKillop; Charles J. Speciale; Howard M. Flournoy

[57] ABSTRACT

Liquid dewaxing product recycled back as input feed in, for example, a lube dewaxing or distillate dewaxing process, provides improved catalyst performance, improved V.I. and improved yield.

8 Claims, 2 Drawing Sheets

LDW FLOW DIAGRAM

FIG. 1 LDW FLOW DIAGRAM
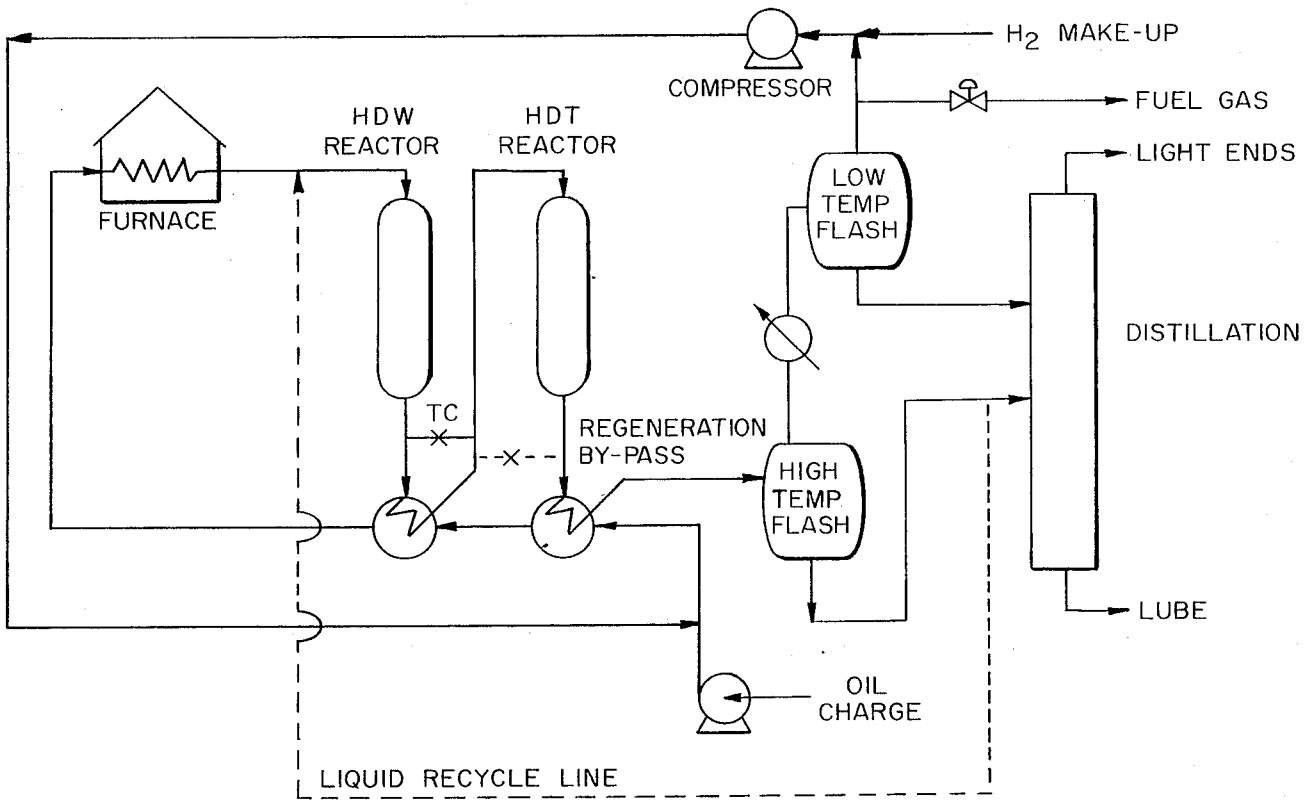

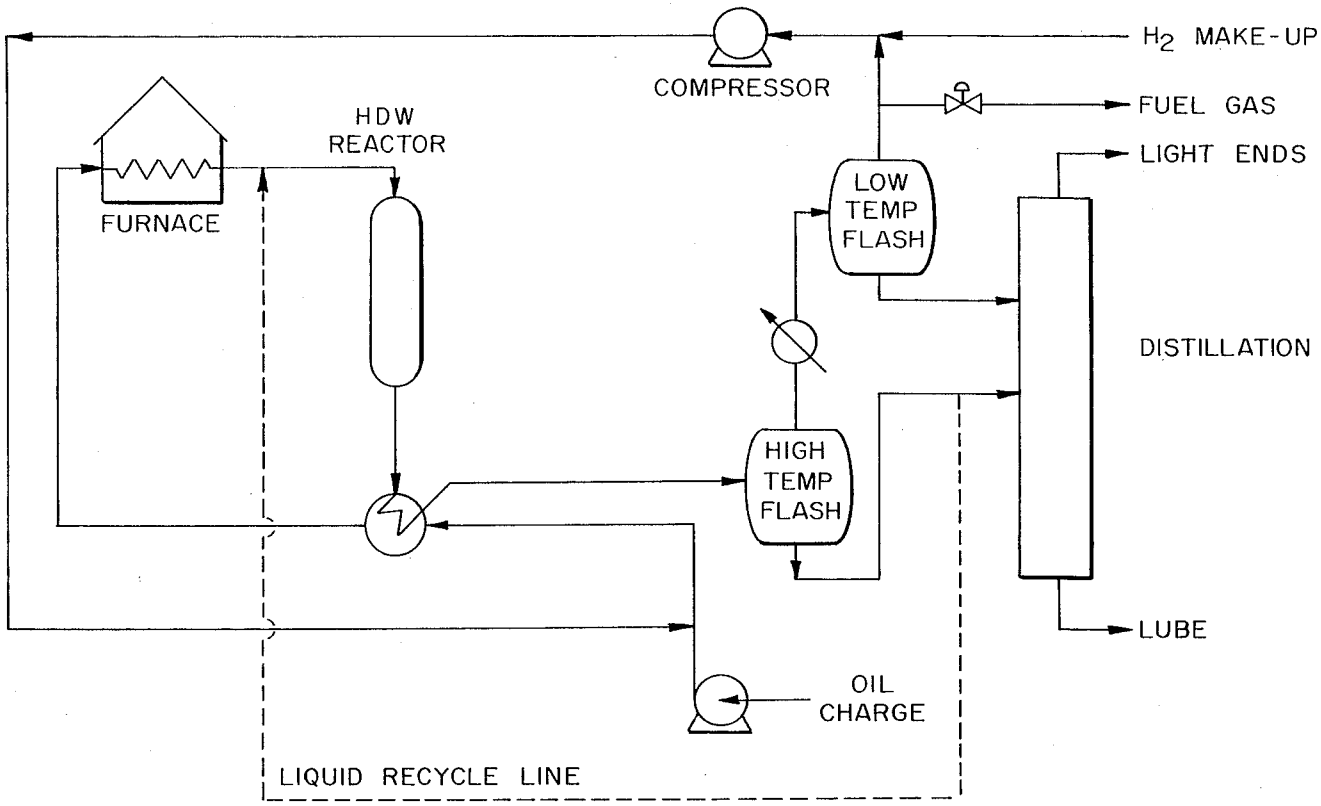
FIG. 2 DDW FLOW DIAGRAM

LIQUID EFFLUENT RECYCLE TO REACTOR IN DEWAXING PROCESSES

This is a continuation of application Ser. No. 767,572, filed on Aug. 20, 1985, now abandoned, which is a continuation of application Ser. No. 005,358, filed Jan. 12, 1987, now abandoned.

BACKGROUND OF THE INVENTION

This invention is concerned with improving the catalytic performance of petroleum upgrading units operated under conditions which tend to cause maldistribution of the charge to the upgrading reactor. This invention is particularly concerned with hydrotreating processes such as catalytic lube dewaxing processes (LDW) wherein product formed in the dewaxing process is fed directly back into the reactor to improve catalyst performance, produce a higher yield of product and a product of higher viscosity index. Also highly suitable for adaptation in accordance with the present invention are catalytic distillate dewaxing (DDW), catalytic hydrodesulfurization (CHD) and heavy oil desulfurization (HOD). Accordingly, the concept disclosed herein should be applicable to any two-phase trickle-bed hydrotreating process.

The catalytic upgrading of petroleum base stock is well known in the art. U.S. Pat. No. 4,191,636 relates to a process for converting heavy hydrocarbon oil containing asphaltenes and heavy metals. Disclosed therein are U.S. Pat. No. 2,559,285, and U.S. Pat. No. 4,062,758 which propose to recycle a part of the liquid reaction product after being separated as a heavy fraction.

U.S. Pat. No. 4,180,453 is directed to a process for treating a hydrocarbon charge (a mixture of a hydrocarbon charge with a recycle fraction) in the presence of a bifunctional catalyst and hydrotreating the resultant effluent to separate nitrogen and sulfur therefrom and subjecting at least a portion of the effluent from the hydrotreatment step to a stream cracking step, recovering a gas oil fraction which is subjected to hydrogenation thereby forming said recycle fraction. Preferably a monofunctional catalyst is used prior to the bifunctional catalyst.

Catalytic dewaxing per se is also known and described in reissue patent, U.S. Pat. No. Re. 28,398 to Chen et al. The use of zeolites is also well known in the art. U.S. Pat. No. 3,778,501 discloses preparation of aromatics by contacting olefins over ZSM-5 type catalysts. U.S. Pat. No. 3,756,942 discloses an aromatization process involving contact of various hydrocarbyl feeds over ZSM-5 type catalysts. U.S. Pat. No. 4,483,760 discloses a process for catalytically dewaxing a middle distillate over a ZSM-5 type catalyst.

The prior art dewaxing processes wherein the catalyst used is of the ZSM-5 type is believed to operate at least in part by selectively cracking the waxy normal and singly methyl-substituted paraffins to form lower molecular weight olefins and paraffins. Regardless of mechanism, such dewaxing results in the formation of a by-product hydrocarbon fraction that has a lower average molecular weight that the charge and a substantial content of olefins. It is thus apparent that dewaxing of various oils and fuels is necessary to facilitate production of the desired dewaxed product in higher yield and improved quality, for example, higher V.I.

SUMMARY OF THE INVENTION

This invention is directed to a process wherein a controlled amount of a dewaxed or hydrotreated hydrocarbyl or hydrocarbonaceous liquid product is recycled as charge feed to provide improved unit performance. Accordingly, this invention is directed to the use of liquid reactor product as a controlled recycle charge to, for example, catalytic lube dewaxing units to improve catalyst bed distribution and catalyst performance. Although this invention is more particularly directed to lube dewaxing and distillate dewaxing units, it is also directed to any refinery hydrotreating or upgrading unit operating in a manner tending to cause maldistribution of the unit's charge stock.

Current lube dewaxing and distillate dewaxing design provides for only a once-through flow of oil over the catalyst bed. The distribution or mixing of the oil and gas phases in the reactor is sensitive to unit charge rate, which can be expressed as liquid mass flux (lb/hr of liquid per $FT^2$ of catalyst bed). When a unit is run at reduced rates, for example, or lower liquid mass flux, the bed exhibits the signs of maldistribution. This maldistribution can be observed as temperature differences between thermocouple well points through the bed and at the reactor outlet. The observed maldistribution is indicative of poor-mixing of the oil and gas phases and results in the catalyst bed not being utilized effectively.

Controlled recycle of liquid product directly back to the treating unit's charge feedstock without being separated into fractions and without further treatment results in the following benefits:

1. Improved catalyst bed performance by maintaining high liquid mass flux independent of fresh feed rate.
2. Improved unit startups by reducing recycle of product back to charge tankage.
3. Reduced impact of any maldistribution associated with poor performance of the unit's distributor trays.
4. Maintenance of high liquid mass flux directionally which improves distribution and reduces possibility of coke formation associated with poor mixing.
5. Reduced product pour points swings, especially during stock changes; thereby reducing product pour point give-away and improving yields.

BRIEF DESCRIPTION OF THE DRAWINGS

FIG. 1 is a process flow diagram illustrating a lube dewaxing configuration.

FIG. 2 is a process flow diagram illustrating a distillate dewaxing configuration.

DETAILED DESCRIPTION OF THE INVENTION

Accordingly, in processes for catalytically treating a hydrocarbonaceous feedstock, said feedstock is contacted under dewaxing conditions in a suitable reactor with a dewaxing catalyst to produce a dewaxed liquid effluent product, the improvement wherein at least a portion of said liquid effluent product without being separated into fractions and without further treatment is continuously recycled independent of fresh feed rate directly back to the dewaxing reactor thereby providing a final product of reduced pour point, improving catalyst bed distribution and performance and reducing feedstock maldistribution. Any hydrocarbonaceous oil, including jet fuels and gas oils, having an unacceptably high pour point that is lowered by conventional dewaxing may be used as feed to the improved catalytic dewaxing process of this invention. Petroleum crudes and syncrudes such as shale oils which tend to be very waxy may be used, either as such, or to provide a suitable distillate fraction for dewaxing. As now contemplated, the present invention is particularly well suited to dewaxing a waxy raffinate that boils within the range of about 600° to about 1050° F. Examples of suitable fractions are waxy raffinates of heavy atmospheric gas oil boiling range material from about 500° to 725° F. and waxy raffinates of vacuum gas oil boiling range material from about 650° to about 1000° F. Although any of the foregoing waxy raffinates are suitable as feeds, the benefits of this invention increase with increasing wax content of said feed.

The catalytic dewaxing procedures employed herein may use any of the typical dewaxing catalysts described in the literature including mordenite, offretite (natural and synthetic), chabazite, analcite, erionite and other natural or synthetic zeolites such as ZSM-5 and other ZSM family zeolites, as well as zeolite A, zeolite X, etc., with or without any added hydrogenation components, such as Group IVB-Group VIII transition metals (and their compounds) (Periodic Table [Handbook of Chemistry and Physics, Chemical Rubber Company, 45th Ed., 1964]), preferably Group VI and Group VIII transition metals, and with or without any decationization of the sites present on the catalytic material, under typical dewaxing conditions of temperature, pressure, hydrogen treat rate, space velocity, etc. Dewaxing will constitute, typically, either hydrocracking or hydroisomerization, depending on the catalyst selected and the conditions employed.

Preferably in the present process, the feed is dewaxed in the presence of a ZSM-5 type catalyst, more fully described hereinbelow, by a process such as that described in U.S. Pat. No. Re. 28,398 to Chen et al, which patent is incorporated herein by reference as if fully set forth. Process modifications such as those described in U.S. Pat. No. 3,956,102 to Chen et al. and in U.S. Pat. No. 4,229,282 to Peters et al. also may be used. These patents, too, are incorporated herein in their entirety by reference. Other variants of the catalytic dewaxing process in which a shape-selective zeolite is used to convert the waxy constituents to an olefinic by-product also are contemplated as suitable for the present invention.

The catalytic dewaxing of this invention may be conducted by contacting the feed to be dewaxed with a fixed stationary bed of catalyst, with a fixed fluidized bed, or with a transport bed, as desired. Typical operating conditions include temperatures of from about 500° to 800° F., and more preferably from 550° to about 750° F. The pressure can range from 200 to 3000 psig, although pressures of 400 to 1000 psig are preferred. Hydrogen can range from 500 to 10,000 SCF/bbl.

The amount and nature of the product produced in the dewaxing step will depend on the nature of the feed, the specific catalyst used, and the dewaxing conditions.

It is understood that applicant is not bound by the particular parameters disclosed above but that any convenient set of reaction conditions known in the art may be used.

The crystalline zeolites highly preferred as catalysts for the present novel process are members of a unique class of zeolites that exhibit unusual properties which comprise a crystalline aluminosilicate zeolite characterized by a silica to alumina ratio of at least about 12, preferably in excess of 30, and a constraint index within the approximate range of 1 to 12. Briefly, the preferred type catalysts useful in this invention possess, in combination: a silica to alumina ratio of at least about 12; and a structure providing constrained access to the crystalline free space.

The silica to alumina ratio referred to may be determined by conventional analysis. This ratio is meant to represent, as closely as possible, the ratio in the rigid anionic framework of the zeolite crystal and to exclude aluminum in the binder or in cationic or other form within the channels. Likewise, this ratio excludes silica added in accordance with the present invention, to the crystalline aluminosilicate zeolite after its formation. Although catalysts with a silica to alumina ratio of at least 12 are useful, it is preferred to use catalysts having higher ratios of at least about 30. Such catalyst, after activation, acquires an intracrystalline sorption capacity for normal hexane which is greater than that for water, i.e. they exhibit "hydrophobic" properties. It is believed that this hydrophobic character is advantageous in the present invention.

Also comtemplated herein as having a Constraint Index of 1 to 12 and therefore within the scope of the novel class of highly siliceous zeolites are those zeolites which, when tested under two or more sets of conditions within the above-specified ranges of temperature and conversion, produce a value of the Constraint Index slightly less than 1, e.g. 0.9, or somewhat greater than 12, e.g. 14 or 15, with at least one other value of 1 to 12. Thus, it should be understood that the Constraint Index value as used herein is an inclusive rather than an exclusive value. That is, a zeolite when tested by any combination of conditions within the testing definition set forth hereinabove and found to have a Constraint Index of 1 to 12 is intended to be included in the instant catalyst definition regardless that the same identical zeolite tested under other defined conditions may give a Constraint Index value outside of 1 to 12.

The class of zeolites defined herein is exemplified by ZSM-5, ZSM-11, ZSM-12, ZSM-20, ZSM-23, ZSM-34, ZSM-35, ZSM-38, ZSM-48, and other similar materials. They are described respectively in various U.S. patents including U.S. Pat. Nos. 3,702,866, 3,709,979, 3,832,449, 3,972,983, 4,076,842, 4,086,186, 4,016,245 and 4,046,859, the entire contents of each is incorporated herein by reference. ZSM-48 can be identified, in terms of moles of anhydrous oxides per 100 moles of silica, and is more fully described in U.S. Pat. No. 4,367,359 and the relevant disclosure therein is incorporated herein by reference.

Although the zeolites may contain silica and alumina, it is recognized that the silica and alumina portion may be replaced in whole or in part by other suitable oxides. For example $GeO_2$ is an art recognized substitute for $SiO_2$, and $B_2O_3$, $CO_3$, $Fe_2O_3$ and $GaO_3$ are art recognized substitutes for $Al_2O_3$.

FIG. 1 illustrates one embodiment of the present invention. Catalytic lube dewaxing in accordance herewith, provides a liquid reactor effluent product containing dewaxed oil of improved pour point (see FIG. 1) and at least a portion of this liquid effluent containing dewaxed lube product is fed directly back via the recycle line to the reactor in controlled amounts without separating it into fractions and without further processing it, independently of fresh feed rate. Up to 70 or 90 wt. % or more of the liquid effluent may be directly fed back to the dewaxing reactor. Preferably 40% up to about 60 wt. %. This novel approach to lube dewaxing results in a lube product of improved V.I. and increased yield as well as decreased catalyst aging rate.

FIG. 2 is another embodiment of the present invention. Catalytic distillate dewaxing in accordance with the invention (see FIG. 2) results in increased yield of dewaxed distillate product (fuel oil of reduced pour point) with improved product quality. As in embodiment 1 at least a portion of the liquid effluent is fed directly back to the dewaxing reactor via a recycle line in controlled amounts. The amount of controlled recycle of liquid effluent may be determined empirically and is dependent upon such factors as the nature of the effluent itself, the nature of the virgin feed, dewaxing conditions and process economics.

It is recognized by those skilled in the art that various modifications may be advantageously incorporated into the process flow diagrams of FIG. 1 and FIG. 2. and accordingly are within the scope of this invention. The dotted lines represent the recycle of liquid product back to the unit reactor.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. In a process for catalytically treating a hydrocarbonaceous petroleum feedstock, said feedstock is contacted under lube dewaxing conditions in a two-phase trickle-bed reactor with a dewaxing catalyst comprising an aluminosilicate zeolite having a constraint index having the approximate range of from about 1 to about 12 and a silica to alumina ratio of at least 12 to 1 to produce a dewaxed liquid effluent product, the improvement wherein about 405 to about 90 wt. % of said liquid effluent product containing dewaxed oil without being separated into fractions and without further treatment is continuously recycled independent of fresh feed rate directly back to the dewaxing reactor thereby improving catalyst bed liquid distribution improving catalyst performance and aging rate and reducing feedstock maldistribution.

2. The process of claim 1 wherein the fresh hydrocarbonaceous petroleum feedstock boils within the range of about 600° to about 1050° F.

3. The process of claim 1 wherein said catalyst is selected from the group consisting of ZSM-5, ZSM-11, ZSM-12, ZSM-20, ZSM-23, ZSM-34, ZSM-35, ZSM-38 and ZSM-48.

4. The process of claim 2 wherein said catalyst is a ZSM-5 catalyst.

5. A process for catalytically dewaxing a hydrocarbonaceous petroleum feedstock comprising contacing said feedstock in a two-phase tricke-bed reactor under lube dewaxing conditions with an aluminosilicate dewaxing catalyst having a constraint index of 1 to 12 and a silica to alumina ratio of at least 12 thereby forming a liquid effluent produt comprising a dewaxed product and continuously recycling 40% to about 90 wt. % of said liquid effluent product without spearation into fractions and without further treatment independently of fresh feed rate directly back to the dewaxing reactor thereby improving catalyst bed distribution and catalyst performance and aging rate by reducing maldistribution of feedstock and providing product of improved V.I. and higher yield.

6. The process of claim 2 wherein from about 60% to about 90 wt. % of said liquid effluent is recycled back to the dewaxing reactor.

7. The process of claim 5 wherein said catalyst is selected from the group consisting of ZSM-5, ZSM-11, ZSM-12, ZSM-20, ZSM-23, ZSM-34, ZSM-35, ZSM-38 and ZSM-48.

8. The process of claim 7 wherein said catalyst is a ZSM-5 catalyst.

* * * * *